US005942147A

United States Patent [19]

Yoshino et al.

[11] Patent Number: 5,942,147

[45] Date of Patent: Aug. 24, 1999

[54] SUBMERGED NOZZLE REPLACING DEVICE

[75] Inventors: Ryoichi Yoshino, Bizen; Kenji Yamamoto, Okayama-Ken; Tadao Taniguchi, Bizen, all of Japan

[73] Assignee: Shinagawa Refractories Co., Ltd., Tokyo, Japan

[21] Appl. No.: 08/930,935

[22] PCT Filed: Feb. 6, 1996

[86] PCT No.: PCT/JP96/00240

§ 371 Date: Oct. 3, 1997

§ 102(e) Date: Oct. 3, 1997

[87] PCT Pub. No.: WO97/28917

PCT Pub. Date: Aug. 14, 1997

[51] Int. Cl.[6] ..... B22D 41/56

[52] U.S. Cl. ..... 222/606; 266/DIG. 1

[58] Field of Search ..... 222/591, 606, 222/607; 266/DIG. 1

[56] References Cited

U.S. PATENT DOCUMENTS

| | | | |
|---|---|---|---|
| 4,091,861 | 5/1978 | Thalmann et al. | 222/606 |
| 5,114,123 | 5/1992 | Pfyl | 222/606 |
| 5,351,865 | 10/1994 | Szadowski et al. | 222/607 |
| 5,688,425 | 11/1997 | Yamamoto et al. | 222/606 |

FOREIGN PATENT DOCUMENTS

| | | |
|---|---|---|
| S48-65813 | 8/1973 | Japan . |
| S54-41539 | 12/1979 | Japan . |
| H3-10425 | 2/1991 | Japan . |
| 3-52760 | 3/1991 | Japan . |
| H6-602 | 1/1994 | Japan . |
| 6-292955 | 10/1994 | Japan . |

*Primary Examiner*—Scott Kastler
*Attorney, Agent, or Firm*—Koda & Androlia

[57] ABSTRACT

A submerged nozzle replacing device comprises a slide valve device 6 for controlling the amount of outflow of molten metal flowing out of a molten metal container, a holding cylinder 21 for a submerged nozzle 9 supported in a vertical posture below the slide valve device, and a guide bar 33 having a pair of parallely provided rail members 33*a* supported in a horizontal posture by a piston rod of the cylinder, and fitted onto a nozzle case 10 at the upper end of the submerged nozzle 9 to hold the nozzle case 10, wherein a guide 32 extending beyond the region of a mold 12 is provided on one side of the slide valve device 6, and a jig holding member 52 for detachably holding a submerged nozzle holding jig 57 is mounted movably on a rail 51 running in the longitudinal direction of the guide 32.

7 Claims, 7 Drawing Sheets

SUBMERGED NOZZLE REPLACING DEVICE

TECHNICAL FIELD

This invention relates to a replacing device for a submerged nozzle which is used to flow molten metal out of a molten metal container.

BACKGROUND ART

An example of a molten metal container such as tundish or ladle is shown in FIG. 14. A tap hole 4 is formed in a nozzle seating block 3 at the bottom 2 of a tundish 1 as a molten metal container. An insert nozzle 5 is inserted through the tap hole 4 into the tundish 1. A lower part of the insert nozzle 5 is supported on the top surface of the periphery of a hole 8 of a bottom plate 7 of a slide valve device (hereinafter referred to as the SV device) 6 mounted on the underside of the tundish 1. At a lower part of the SV device 6, an upper part of a submerged nozzle 9 is held in a suspended manner by a submerged nozzle support device 11 via a nozzle case 10.

In continuous casting equipment, as shown in FIG. 15, a lower part of the submerged nozzle 9 is immersed in molten metal 13 contained in a mold 12 of a water-cooled structure. Through outlets 9*a* formed at the periphery of the lower part of the submerged nozzle 9, molten metal 13 is continuously poured into the mold 12. Molten metal 13 cooled at the peripheral surface in the mold 12 gradually solidifies. During this period, the molten metal 13 is discharged from the bottom to be guided to a next step.

The SV device 6 operates in the following manner: A slide plate 16 is connected to a piston rod 15 of a hydraulic cylinder 14 so as to slide in a horizontal direction. When the hydraulic cylinder 14 is actuated, the slide plate 16 slides to bring a hole 17 of the slide plate 16 into or out of alignment with the hole 8 of the bottom plate 7. As a result, the amount of molten metal outflow is controlled.

The submerged nozzle 9 has a somewhat increased-diameter upper end, which is fitted into the nozzle case 10. The upper end face of the submerged nozzle 9 is pressed against the lower end face of a chute nozzle 18 via a seal packing (not shown). On the outer surface of the nozzle case 10, support pins 19, 19 protrude at diametrically symmetrical positions.

As described above, the lower portion of the submerged nozzle 9 is always immersed in a molten metal and washed thereby. Since it is thus damaged and worn, it should be replaced, where necessary, by a fresh submerged nozzle 9.

Under these circumstances, the submerged nozzle support device 11 has been used which can rapidly replace the submerged nozzle 9. In the conventional example of FIG. 14, an air cylinder 21 with a downwardly facing piston rod 20 is provided on the underside of the SV device 6. To the piston rod 20 of the air cylinder 21, a support arm 22 is secured. On the distal end of the support arm 22, recesses 23 are provided so that the submerged nozzle 9 is held in a suspended state by the support pins 19, 19 of the nozzle case 10. Into the recesses 23, the support pins 19, 19 of the nozzle case 10 are fitted, and then the air cylinder 21 is contracted. Thereby, the upper end face of the submerged nozzle 9 is pressed against the lower face of the periphery of the hole 17 of the slide plate 16 of the SV device 6, or if the SV device 6 is provided with the chute nozzle 18, it is pressed against the lower surface of the chute nozzle 18 via the seal packing. By this measure, the submerged nozzle 9 is fixed. The fixing means may employ a lever system or a toggle mechanism.

In replacing the submerged nozzle 9, however, the above-described device requires the following procedure: The slide plate 16 of the SV device 6 is caused to slide until its hole 17 is closed. The tundish 1 is raised, and then the air cylinder 21 is extended to lower the support arm 22. The submerged nozzle 9 is then removed manually, and the underside of the chute nozzle 18 is cleaned. Then, a fresh submerged nozzle 9 and a seal packing are set. Thereafter, the air cylinder 21 is contracted to lift the submerged nozzle 9, and the tundish 1 is lowered simultaneously. The slide plate 16 of the SV device 6 is caused to slide until its hole 17 is opened.

This replacement work takes 60 to 90 seconds at the earliest, thus posing a major problem: During this replacement of submerged nozzle 9, the surface of the molten metal 13 in the mold 12 solidifies, and the seams of the molten metal 13 are reduced to scrap. Consequently, the yield drops.

It may be attempted to shorten the time during which the withdrawal of the molten metal 13 is interrupted. However, the submerged nozzle 9 after use must be detached, and a fresh submerged nozzle 9 set. Thus, there are limits to shortening the time. One may try not to move the tundish 1 up and down, but to cut the time required for this upward and downward movement. However, the presence of the SV device 6 makes the space below the tundish 1 narrow. Replacement work within this narrow space is very laborious, making rapid replacement difficult.

Furthermore, the replacement work is done manually. The submerged nozzle itself is made of refractory, so that it is heavy and its mounting and dismounting are not easy. The surroundings of the SV device 6 are at extremely high temperatures. The work must be done under hot conditions, meaning an adverse work environment. From this aspect as well, the work is intractable.

Technologies for further facilitating replacement work for the submerged nozzle are described in Japanese Laid-Open Patent Publication Nos. 292955/94 and 52760/91. These techniques use a running trolley, and place a handling device on the trolley. The trolley is moved to a predetermined position to hold the submerged nozzle, so that the submerged nozzle is mounted at the bottom of the SV device. The apparatus used is itself grandly structured, and costs heavily. A wide space must be secured for its movement. In addition, the handling device is actuated after the trolley is moved to the position of submerged nozzle replacement. Thus, the operation of the apparatus is so slow that the replacement of the submerged nozzle takes time. These earlier technologies are unable to solve the aforementioned problems completely.

An object of the present invention is to provide a submerged nozzle replacing device which can rapidly perform replacement work for a submerged nozzle, eliminate the casting interruption time, and dissolve the scrapping that occurs at the seams of molten metal.

Another object of the invention is to provide a submerged nozzle replacing device which enables the setting of a fresh submerged nozzle, its mounting on the SV Device, and the withdrawal of the used submerged nozzle to be performed by a single guide efficiently and less laboriously.

DISCLOSURE OF THE INVENTION

The present invention is characterized by having a slide valve device for controlling the amount of outflow of molten metal flowing out of a molten metal container; a holding cylinder for a submerged nozzle supported in a vertical posture below the slide valve device; and a guide bar having a pair of parallely provided rail members supported in a horizontal posture by a piston rod of the cylinder, and fitted onto a nozzle case at the upper end of the submerged nozzle to hold the nozzle case; wherein a guide extending beyond the region of a mold is provided on one side of the slide valve device, and a jig holding member for detachably holding a submerged nozzle holding jig is mounted movably on a rail running in a longitudinal direction of the guide.

The present invention is also characterized in that the jig holding member is mounted on the rail of the guide via a linear bearing, and the base of the guide is supported on one side of the nozzle center position of the slide valve device so that the guide can be turned in a horizontal plane to take submerged nozzle mounting and withdrawing positions parallel to the mold, and a submerged nozzle setting position at right angles to the mold.

The present invention is further characterized in that the jig comprises a pipe material having a handle at the base end thereof, being capable of fitting over a support pin of the nozzle case of the submerged nozzle, and having a flanged sleeve rotatably fitted thereover at a midway portion thereof; and a bifurcated lever provided near a distal end thereof to fit over the trunk of the submerged nozzle; and the jig holding member has a jig holding portion onto which the sleeve of the jig fallen from above is fitted.

BEST MODE FOR CARRYING OUT THE INVENTION

Figure 14:
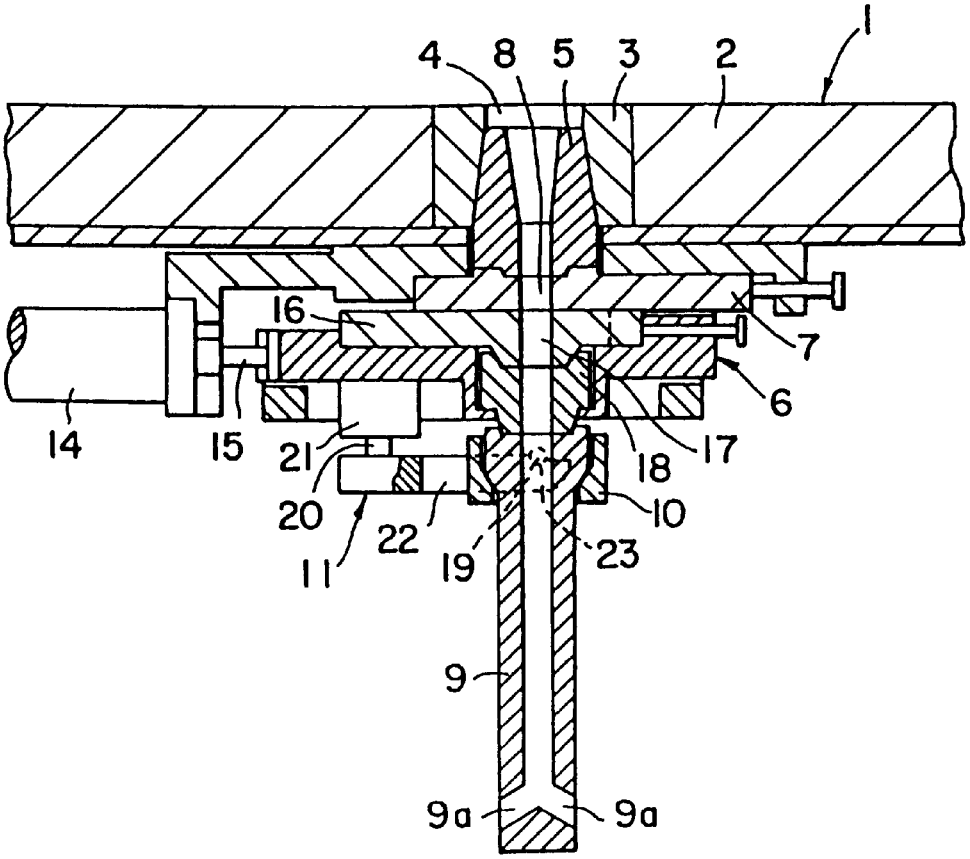
F I G. 14 PRIOR ART
FIG. 14 is a sectional view showing prior art.
Figure 15:
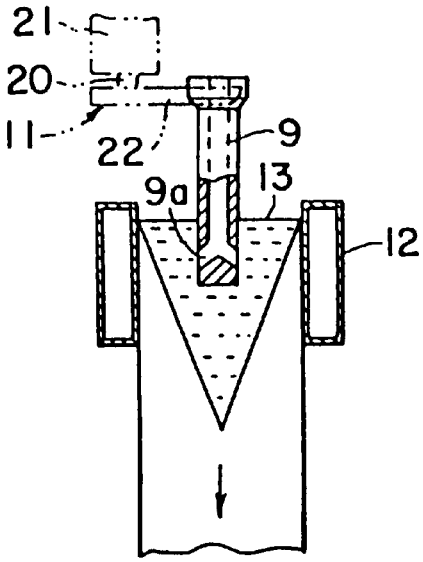
FIG. 15 is an explanatory view showing the relationship between continuous casting equipment and a submerged nozzle.

The present invention will now be described in more detail with reference to the accompanying drawings, with members common to FIGS. 14 and 15 being assigned the same numerals as in these figures.

Figure 1:
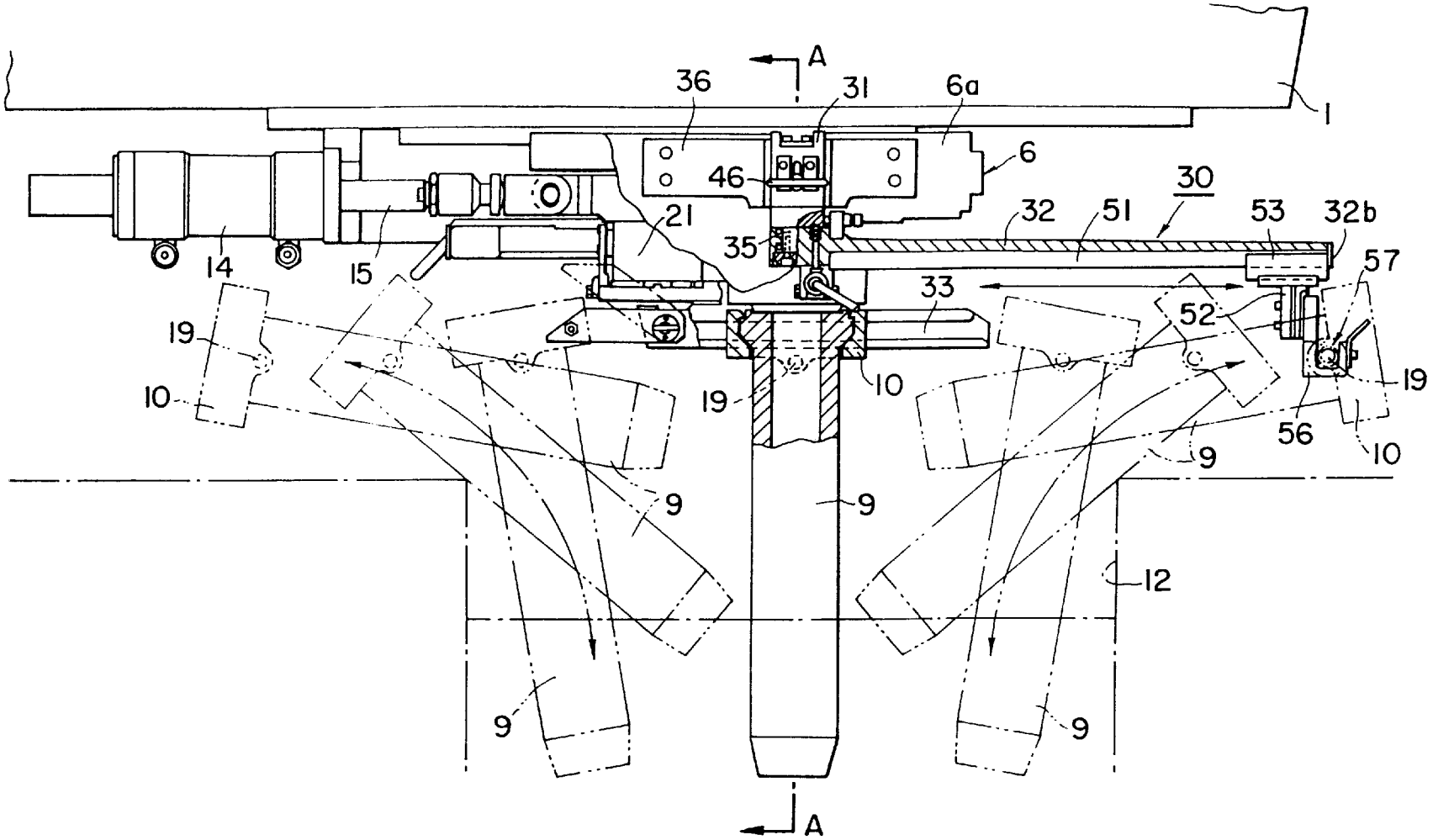
FIG. 1 is a sectional view showing an embodiment of a submerged nozzle replacing device according to the present invention.
Figure 2:
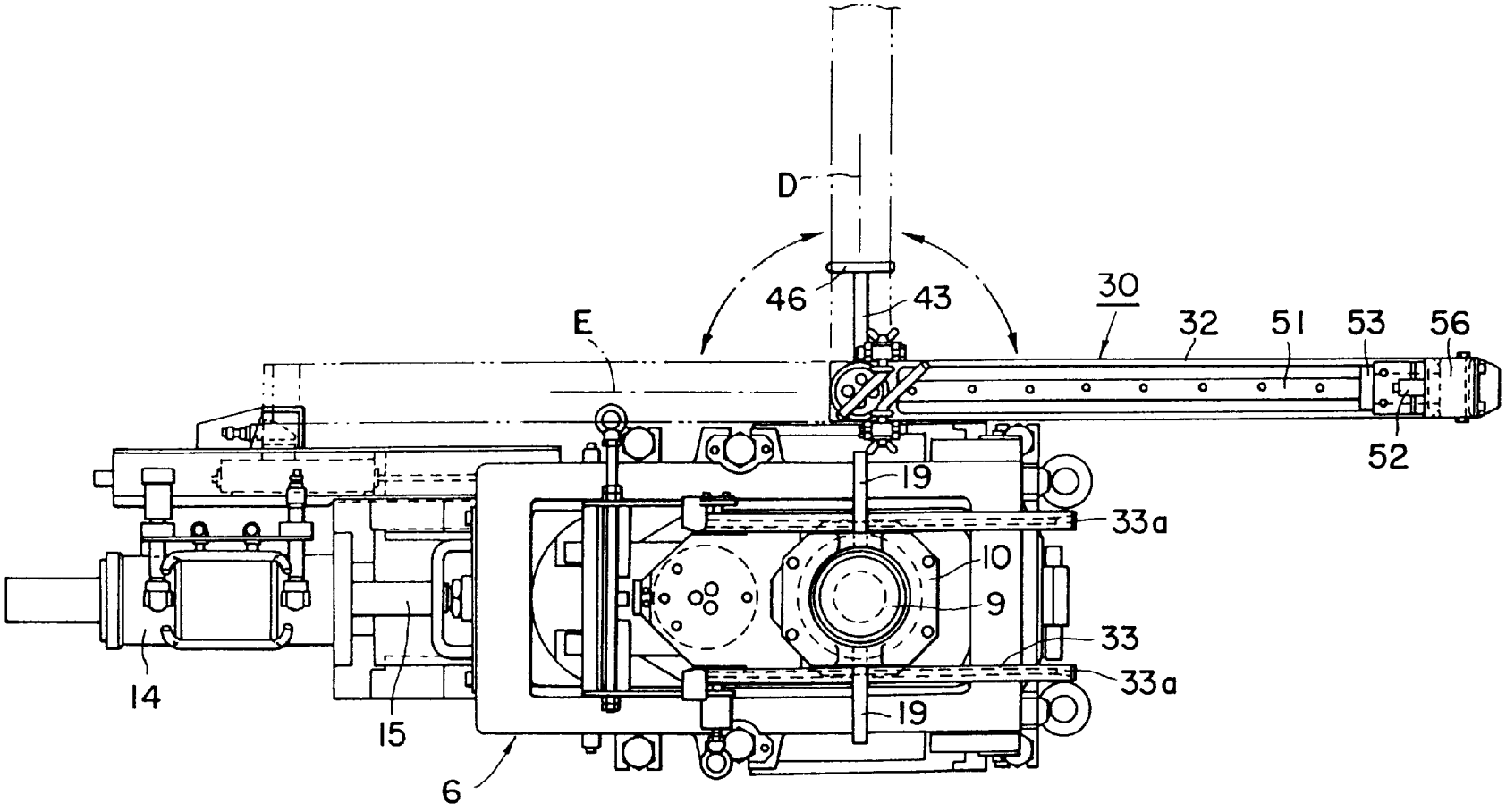
FIG. 2 is a bottom view of FIG. 1.
Figure 3:
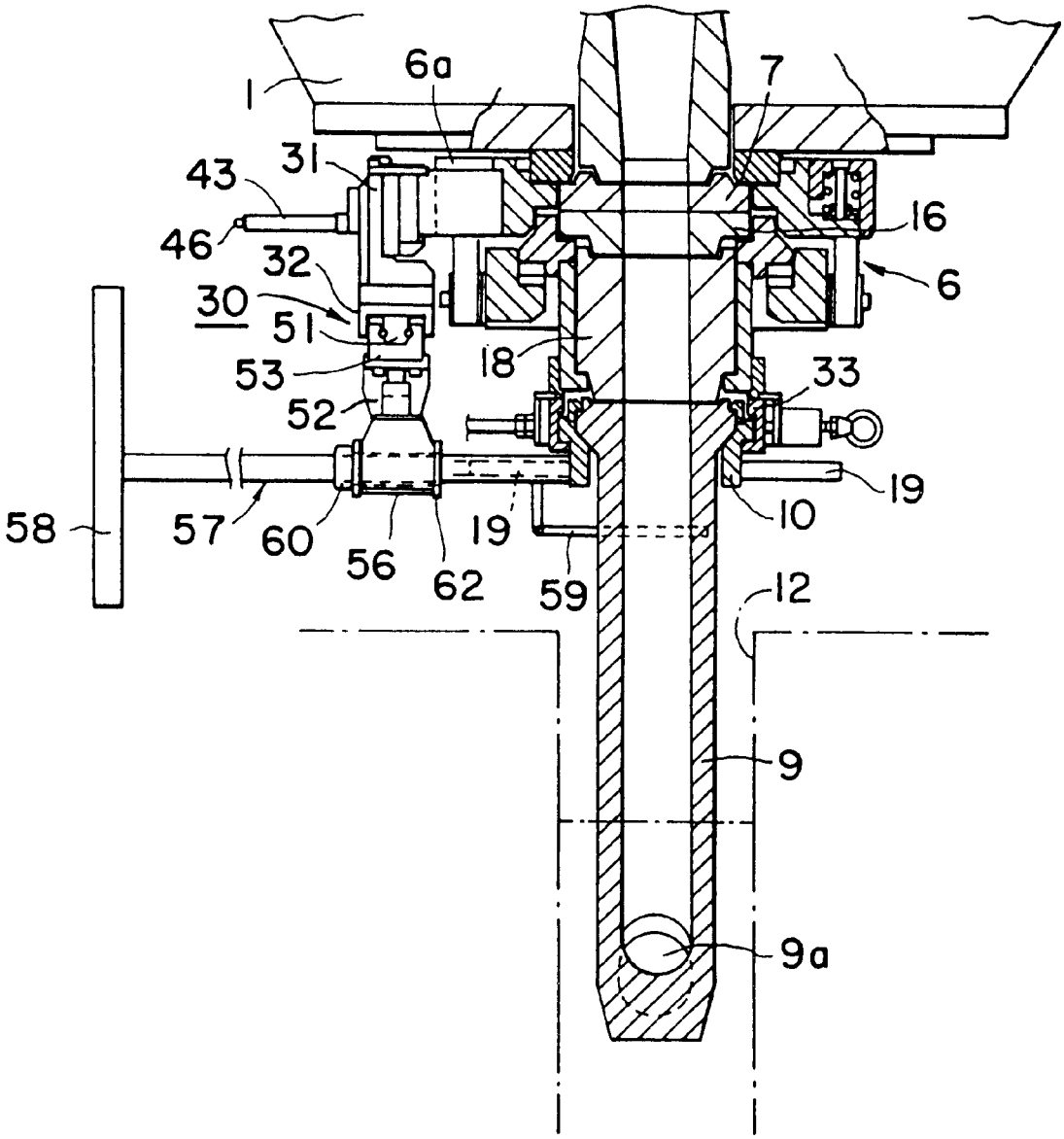
FIG. 3 is a sectional view taken on line A—A of FIG. 1.

FIG. 1 shows a case in which a submerged nozzle replacing device according to the present invention is applied to a tundish 1 as an example of a molten metal container. FIG. 2 is a bottom view of FIG. 1, and FIG. 3 is a sectional view taken on line A—A of FIG. 1.

On the underside of the tundish 1, an SV device 6 is mounted. On one side of the body 6*a* of the SV device 6, a submerged nozzle replacing device 30 according to the present invention is mounted.

Figure 4:
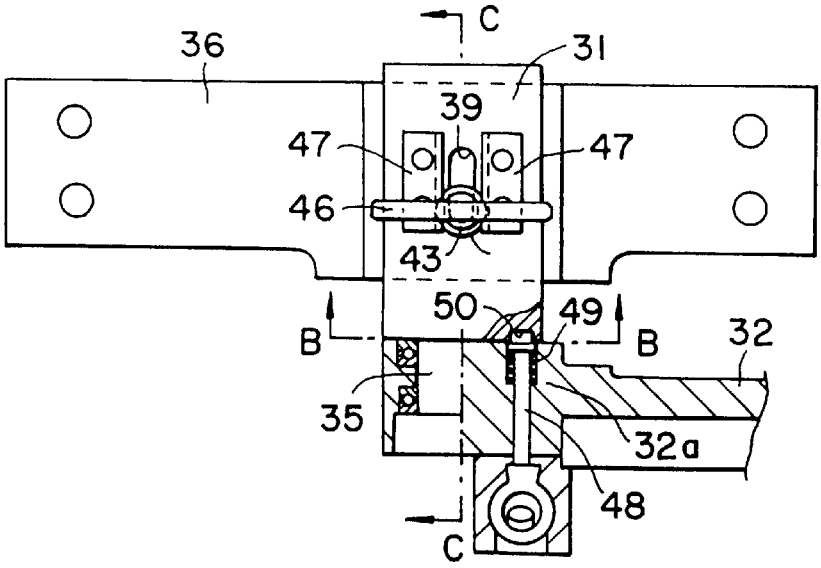
FIG. 4 is a partly sectional front view showing the site of mounting of a guide.
Figure 5:
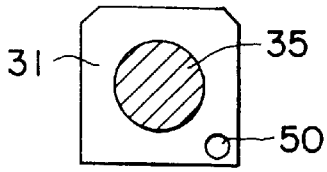
FIG. 5 is a sectional view taken on line B—B of FIG. 4.

The submerged nozzle replacing device 30 has a guide 32 detachably mounted on the body 6*a* of the SV device 6 via a fixing base 36 and a bracket 31 as shown in FIGS. 1 and 4. Below the SV device 6, a guide bar 33 is provided so as to be movable upward and downward by an air cylinder 21, the guide bar 33 comprising a pair of rail members 33*a*, 33*a* which engage a nozzle case 10 at an upper part of a submerged nozzle 9 and support the nozzle case 10 so as to be slidable.

The guide 32 is in the shape of a transversely elongated beam. The bracket 31 is attached to the base 32*a* of the guide 32 so as to be rotatable about a vertical shaft 35 and is detachably attached by a locking handle 43 to the fixing base 36 fixed to the side surface of the body 6*a* of the SV device 6. The symbol 32*b* denotes a stopper provided at the distal end of the guide 32.

The mounting structure for the guide 32, as shown in FIGS. 4 to 10, is such that the fixing base 36 has an insertion hole 38 comprising an upper large-size hole 38*a* and a lower small-size hole 38*b* communicating therewith. Around the inner end of the small-size hole 38*b*, a larger-size U-shaped stepped hole 38*c* is formed.

In the bracket 31, a vertically elongated insertion hole 39 is formed. A locking shaft 40 is inserted through the insertion hole 39 into the insertion hole 38. The locking shaft 40 has at its inner end a locking head 41 of a regularly tetragonal shape chamfered at four corners that can fit into the stepped hole 38*c* as tightly as possible. The outer end side of the locking shaft 40 is formed into an external thread 42 of a length projecting from the outer surface of the bracket 31.

Onto the external thread 42 of the locking shaft 40, an internal thread 44 at the tip end of the locking handle 43 is screwed. The locking handle 43 has a collar-shaped projection 45 on the outer periphery of its front end, and has a handle 46 at its base end. The projection 45 engages stoppers 47, 47 provided on both sides of the insertion hole 39 of the bracket 31, and slides upward and downward along them, but does not slip them off.

When the locking handle 43 is turned to tighten the locking shaft 40, the locking head 41 of the locking shaft 40 is pressed against the fixing base 36. By the resulting reaction force, the projection 45 of the locking handle 43 is pressed against the bracket 31, bringing both members into a fixed state.

At the base 32*a* of the guide 32, a stopper pin 48 is provided so as to pass therethrough vertically as shown in FIG. 4. The stopper pin 48 has its front end slightly protruding from the top surface of the base 32*a* by the action of a spring 49 incorporated in the base 32*a*. On the side of the bracket 31, a stopper hole 50 is provided into which the tip end of the stopper pin 48 is fitted. The stopper hole 50 is located at a position where the submerged nozzle 9 is supported by the guide 32, namely, at a position where the stopper pin 48 can be fitted in when the submerged nozzle 9 is placed at the position shown in FIGS. 1 and 2.

Figure 11:
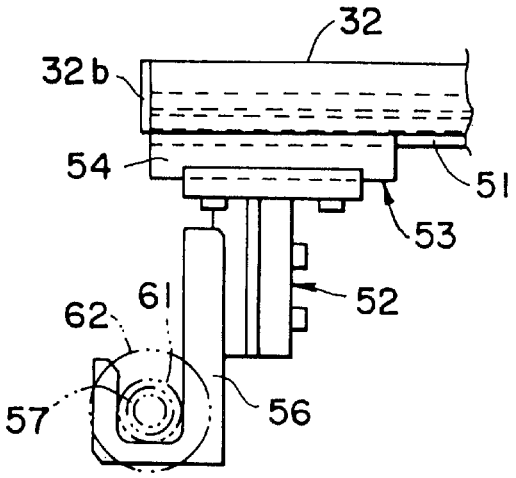
FIG. 11 is a side view of a jig holding member.
Figure 12:
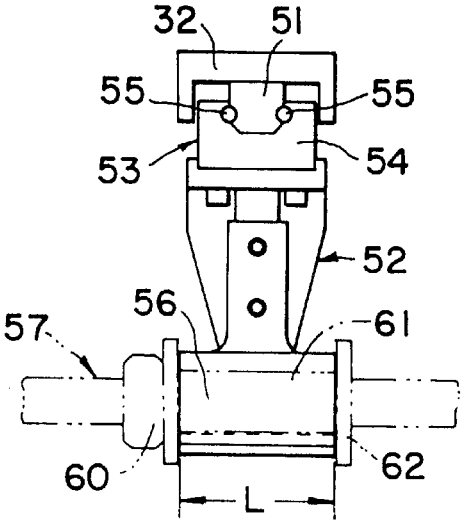
FIG. 12 is a front view of the jig holding member.

The guide 32, as illustrated in FIG. 3, has an inverted U-shaped section. On the underside of its upper part, a rail 51 having grooves of a semicircular section on both side surfaces thereof is provided longitudinally. A jig holding member 52 is slidably supported by the rail 51 via a linear bearing 53. As shown in FIGS. 11 and 12 on an enlarged scale, a linear bearing case 54 above the jig holding member 52 seals balls 55, constituting the linear bearing 53, between the grooves of the rail 51 and grooves of the inside surfaces of the linear bearing case 54. Thus, the jig holding member 52 can slide smoothly along the rails 51.

The jig holding member 52, as shown in FIGS. 11 and 12, has a jig holding portion 56 of a nearly U-shaped section. The jig holding portion 56 has a length L in an axial direction perpendicular to the moving direction of the jig holding member 52.

Figure 13:
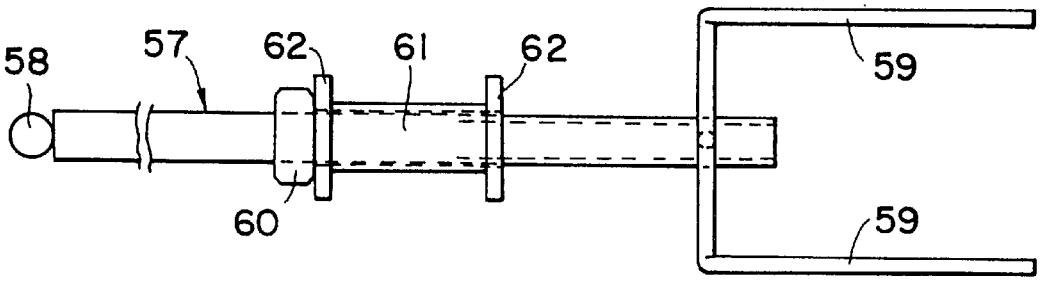
FIG. 13 is a front view of a jig.

A jig 57 is composed of a pipe material having a handle 58 at one end, and having an inner diameter capable of fitting over one of the support pins 19, 19 protruding on a diametrical line on both sides of the nozzle case 10 of the submerged nozzle 9. At a position nearer to the front end of the jig 57, a bifurcated fork-shaped branch lever 59 for engaging the trunk of the submerged nozzle 9 is fixed as shown in FIG. 13. Between the handle 58 and the root of the branch lever 59, a stopper 60 is provided. A sleeve 61 is fitted over the part between the stopper 60 and the root.

The sleeve 61 has flanges 62, 62 at both ends, and the inside dimension between the flanges 62 and 62 is slightly larger than the length L of the jig holding portion 56. This part between the flanges 62 and 62 is fitted from above onto the jig holding portion 56 so as to be held thereby.

The fit clearance between the pipe material of the jig 57 and the sleeve 61, the dimensional difference between the inside dimension of the flanges 62, 62 of the sleeve 61 and the jig holding portion 56, and the dimensional difference between the inside width of the jig holding portion 56 and the outside diameter of the sleeve 61 are each preferably set at about 0.2 to 1.0 mm. Any of the dimensional differences greater than this value would make it impossible to retain the perpendicularity between the guide 32 and the jig 57, or to maintain the horizontal posture of the jig 57. Smaller dimensional differences, on the other hand, are not preferred, either, because the task for setting on the jig holding portion 56 would be difficult. The slide or rotation of the jig 57 relative to the sleeve 61 would also become difficult.

The actions of the above-described embodiment will be explained.

Figure 6:
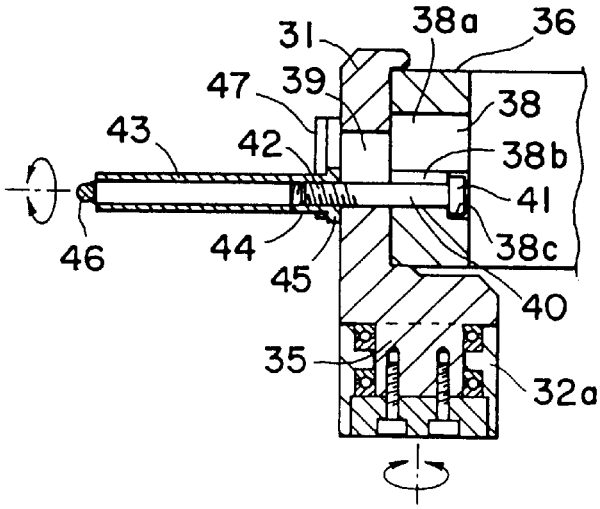
FIG. 6 is a sectional view taken on line C—C of FIG. 4.
Figure 7:
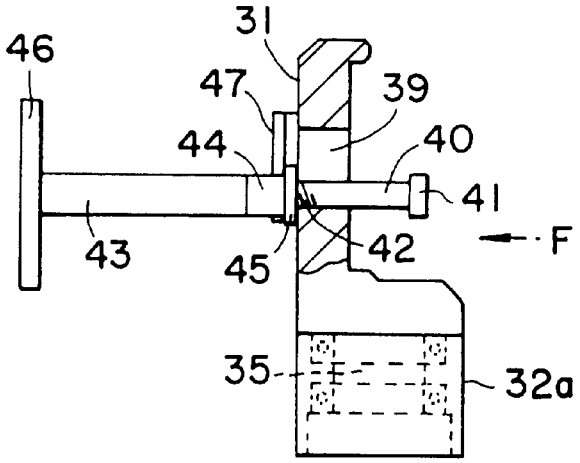
FIG. 7 is a sectional view of a bracket.
Figure 8:
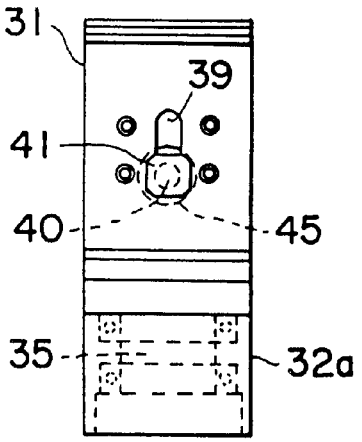
FIG. 8 is a partly sectional view taken in the direction of an arrow F in FIG. 7.
Figure 9:
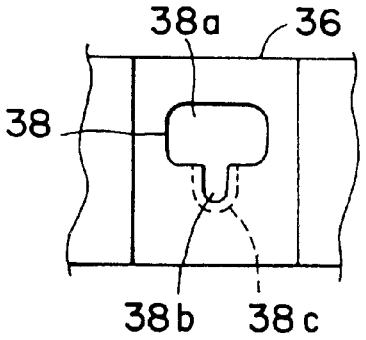
FIG. 9 is a front view of an insertion hole of a fixing base.
Figure 10:
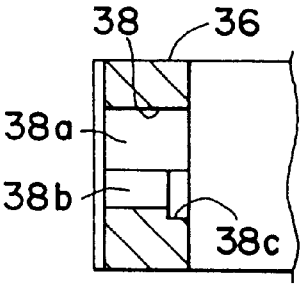
FIG. 10 is a sectional view of the insertion hole of the fixing base.

The locking shaft 40 of the locking handle 43 built into the bracket 31 of the submerged nozzle replacing device 30 is inserted into the large-size hole 38*a* of the insertion hole 38 of the fixing base 36, and then transferred into the small-size hole 38*b*. As a result, the locking head 41 of the locking shaft 40 enters the stepped hole 38*c* and becomes unwithdrawable. When the handle 46 of the locking handle 43 is turned for tightening, the projection 45 of the locking handle 43 and the locking head 41 of the locking shaft 40 firmly fix the bracket 31 to the fixing base 36, as shown in FIG. 6.

When a fresh submerged nozzle 9 is to be set, the guide 32 is turned to a position at right angles to the SV device 6 (mold 12) as indicated by a symbol D in FIG. 2. The jig holding member 52 is located at a position where it contacts the stopper 32*b* at the distal end of the guide 32.

Then, the tip end of the jig 57 is fitted over the support pin 19 present on one side of a preheated fresh submerged nozzle 9. The sleeve 61 of the jig 57 is fallen from above and fitted onto the jig holding portion 56 of the jig holding member 52. The bifurcated branch lever 59 of the jig 57 supports the trunk of the submerged nozzle 9 to keep the submerged nozzle 9 in a horizontal posture with the nozzle case 10 facing rearward. Then, the guide 32 is turned to a position parallel to the mold 12 (the position in FIGS. 1 to 3). At the turning end position, the stopper pin 48 is fitted into the stopper hole 50 of the bracket 31 to set the guide 32 in place. Then, the jig holding member 52 is caused to slide toward the center of the SV device 6 by gripping the jig 57. The jig holding member 52 gently slides along the rail 51 of the guide 32 by the action of the linear bearing 53. Then, the handle 58 of the jig 57 is slowly turned to shift the submerged nozzle 9, supported by the bifurcated lever 59, gradually to an upright posture. The changing state of the submerged nozzle 9 is shown by two-dot chain lines in FIG. 1. While in a gradually changed posture, the submerged nozzle 9 is guided into the mold 12. The nozzle case 10 holding the fresh submerged nozzle 9 shifted to a vertical posture is accepted between the right and left rail members 33*a*, 33*a* of the guide bar 33. Then, a sealing packing is placed on the upper end of the submerged nozzle 9.

In replacing the submerged nozzle 9, on the other hand, the guide 32 is turned 180° from the state indicated by a solid line in FIG. 2 to the state shown by the symbol E. Furthermore, a hydraulic cylinder 14 of the SV device 6 is actuated to close a hole 17 of a slide plate 16 of the SV device 6. The air cylinder 21 is operated to lower the guide bar 33. A fresh submerged nozzle 9 is caused to slide to a predetermined position, with the used submerged nozzle 9 being pushed out by a cylinder (not shown) along the guide bar 33. Then, the guide bar 33 is hoisted, and the fresh submerged nozzle 9 is pressed against the underside of a chute nozzle 18, thus completing its mounting. Then, the hole 17 of the slide plate 16 is opened to resume the outflow of molten metal and begin casting.

To withdraw the used submerged nozzle 9 supported by the guide bar 33, the first task is to put the guide 32 to the state E shown in FIG. 2. The jig 57 is fitted over the support pin 19 of the nozzle case 10 holding the used submerged nozzle 9 supported in a suspended manner by the guide bar 33. Also, the sleeve 61 of the jig 57 is fitted onto the jig holding portion 56 of the jig holding member 52. Then, the jig holding member 52 is caused to slide along the rail 51 of the guide 32. During this sliding motion, the handle 58 of the jig 57 is turned to shift the submerged nozzle 9 gradually to a horizontal posture as shown by two-dot chain lines in FIG. 1, while taking it out of the mold 12. Then, the jig 57 is detached from the jig holding member 52. The used submerged nozzle 9 is disposed of.

Then, the submerged nozzle replacing device 30 is removed from the SV device 6. That is, the locking handle 43 is loosened unlike the mounting procedure. The locking handle 43 is moved upward, whereby the locking head 41 of the locking shaft 40 is released from the stepped hole 38*c*. Then, it is withdrawn from the large-size hole 38*a* of the insertion hole 38 of the fixing base 36, whereupon the bracket 31 is detached from the fixing base 36. Thus, the guide 32 including the jig holding member 52 can be dismounted from the SV device 6.

INDUSTRIAL APPLICABILITY

The submerged nozzle replacing device of the present invention is suitable for use in replacing a submerged nozzle for flowing molten metal from a molten metal container into a mold in continuous casting equipment.

What is claimed is:

1. A submerged nozzle replacing device comprising:

a holding cylinder for a submerged nozzle supported in a vertical posture below a slide valve device for controlling outflow of a molten metal flowing out of a molten metal container;

a horizontally extending guide bar having a pair of parallel rail members for supporting and slidingly guiding therealong a nozzle case fitted on an upper end of the submerged nozzle;

means for moving said guide bar upward relative to said slide valve;

an elongated guide member provided horizontally at a side of said slide valve and having a horizontal guide rail;

a vertical shaft disposed adjacent a center of said slide valve device and provided on and under said molten metal container, for supporting a proximal end of said guide member to enable said guide member to turn in a horizontal plane from a nozzle mounting angular position in which the guide member extends parallel to said guide bar in one direction, through a nozzle setting angular position in which the guide member extends perpendicularly to said guide bar, and a nozzle withdrawing angular position in which the guide member extends parallel to said guide bar in a direction opposite to said one direction;

a jig for holding said nozzle case on the submerged nozzle; and a jig holding member for detachably holding said jig, said jig holding member being mounted on said guide member for sliding movement along the guide rail of the guide member.

2. The submerged nozzle replacing device of claim 1, further comprising:

a linear bearing for mounting said jig holding member on said guide rail of the guide member.

3. The submerged nozzle replacing device of claim 1, wherein said vertical shaft is provided on a bracket which is detachably mounted on said molten metal container.

4. The submerged nozzle replacing device of claim 1, wherein said jig holding member has a U-shaped jig holding portion.

5. The submerged nozzle replacing device of claim 4, wherein said jig comprises:

a pipe;

a handle provided at one end of the pipe for rotary operation of the handle; and a holding portion provided at the other end of the pipe for holding a submerged nozzle.

6. The submerged nozzle replacing device of claim 5, wherein said holding portion comprises a bifurcated lever.

7. The submerged nozzle replacing device of claim 5, wherein said jig has:

a sleeve provided rotatably between said handle and said holding portion and with a pair of flanges on two ends of the sleeve, said sleeve being sized to be received in said U-shaped jig holding portion.

* * * * *